US005416938A

United States Patent [19]

Li

[11] Patent Number: 5,416,938

[45] Date of Patent: May 23, 1995

[54] FASTENER PREVENTING QUILTS FROM BEING KICKED OFF

[76] Inventor: Jung-Lin Li, No. 58, Yeh Tzu Liao, Alley 7, Tung Hsing Rd. Min Hsiung Hsiang, Chia Yi Hsien, Taiwan, Prov. of China

[21] Appl. No.: 175,582

[22] Filed: Dec. 30, 1993

[51] Int. Cl.[6] ..... A47G 9/04

[52] U.S. Cl. ..... 5/494; 5/922; 2/69

[58] Field of Search ..... 5/494, 655, 482, 922, 5/923; 2/69, 69.5; 128/872

[56] References Cited

U.S. PATENT DOCUMENTS 2,325,097 7/1943 Behringer ..... 5/494

3,987,505 10/1976 Hickey ..... 5/494

4,802,244 2/1989 McGrath-Salem ..... 5/494

4,989,286 2/1991 Tucker ..... 5/482

FOREIGN PATENT DOCUMENTS 666153 10/1965 Belgium ..... 5/494

*Primary Examiner*—Alexander Grosz

*Attorney, Agent, or Firm*—Morton J. Rosenberg; David I. Klein

[57] ABSTRACT

A fastener for preventing quilts from being kicked off is provided. The fastener includes a quilt and a wrapping sheet which have corresponding hook-and-loop type fasteners for wrapping a child's body and firmly securing the quilt over the child.

1 Claim, 3 Drawing Sheets

FASTENER PREVENTING QUILTS FROM BEING KICKED OFF

FIELD OF THE INVENTION

This invention relates to a fastener, and more particularly to a fastener which prevents a quilt form being kicked off by a child.

BACKGROUND OF THE INVENTION

It has become a very general problem for many families with young children, that the children sometimes kick their quilt or blanket off while in bed because they feel relatively warm. But, the surface temperature of their body will drop after they fall asleep, as the room temperature drops during the night. Therefore, the children will be susceptible to catching a cold. Another problem is that when children change their sleeping position, the quilt will also shift its position and sometimes slip off their body.

In view of this, the inventor has derived the present invention which will hold the quilt or blanket firmly over a child's body.

SUMMARY OF THE INVENTION

It is the primary object of the present invention to provide a fastener for preventing a quilt from being kicked off, and which will hold the quilt firmly over a child's body, without being kicked off either accidentally or intentionally.

It is another object of the present invention to provide a fastener for preventing a quilt from being kicked off which has a screen for air to flow therethrough to prevent a child from getting a rash from sweating.

It is a further object of the present invention to provide a fastener for preventing a quilt from being kicked off where the fastener is adjustable to fit children of different body sizes.

It is still a further object of the present invention to provide a fastener for preventing a quilt from being kicked off which is easy to use.

DETAILED DESCRIPTION OF THE PREFERRED EMBODIMENT

Figure 1:
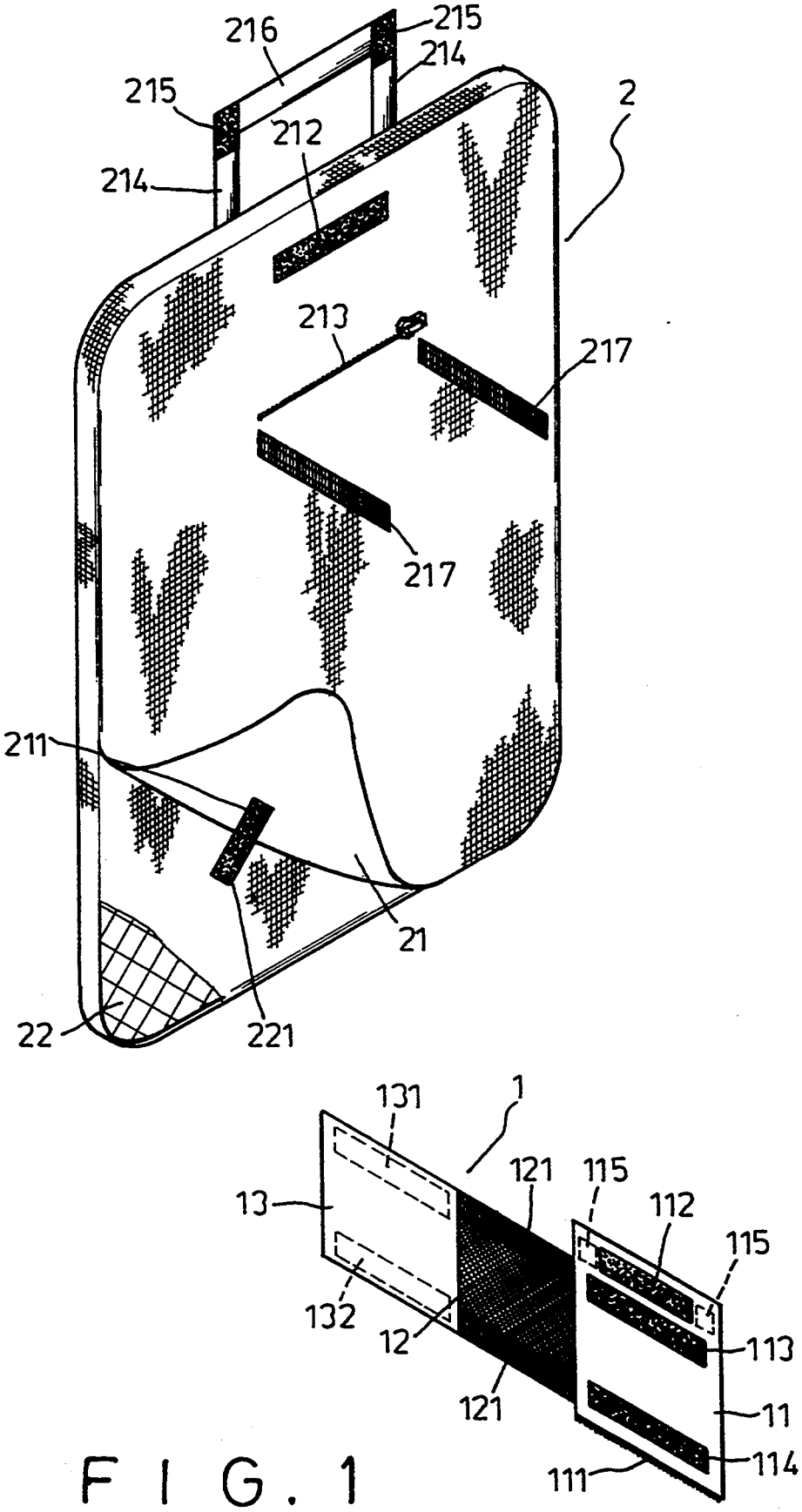
FIG. 1 is a perspective view of a quilt and a wrapping sheet of the present invention.

Referring now to the drawings, FIG. 1 shows a wrapping sheet 1, and a quilt 2 of the present invention.

The wrapping sheet 1 is composed of three covers, an inner cover sheet 11, a screen 12, and an outer cover sheet 13. The inner cover sheet 11 has zipper teeth 111 at the bottom edge, and three strips 112, 113 and 114 of one element of a hook-and, loop type fastener, such as one sold under the Trademark of VELCRO. Fastening strips 112, 113 and 114 are disposed on top, middle and bottom portions thereof, on one side which hereinafter is designated as the inside of the inner cover 11. Two hook-and-loop type fastening elements 115 are provided at the top respective corners on the opposing side of inner cover 11 which hereinafter is defined as the outside of the inner cover sheet 11.

The screen 12, having one end connected to the inner cover sheet 11 and the opposing end connected to an edge of the outer cover sheet 13, includes a pair of elastic bands 121 disposed at the top and bottom portions, respectively. The outer cover sheet 13 is shorter in height than the height of the inner cover sheet 11 and has a pair of hook-and-loop type fastening strips 131, 132 at the top and bottom portions of one side thereof in alignment with the middle and bottom fastening strips 113, 114 of the inner cover sheet 11. The fastening elements 131, 132 being complementary to elements 113, 114, such that one pair 113, 114 or 131, 132 are hook-type elements and the other pair 131, 132 or 113, 114 are loop-type elements, as is conventional for use of such fastening elements.

The quilt 2 is composed of a quilt sheet 21 covering a fluffed cotton 22 by means of fasteners, such as the respective hook-and-loop type fastening strips 211 and 221. A pair of cloth strips 214 are coupled on the top of the quilt sheet 21 and extend outward from one end thereof. A pair of hook-and-loop type fastening elements 215 are respectively disposed at the distal ends of the pair of cloth strips 214. A second pair of cloth strips are coupled to one side of the quilt sheet 21 and extend outward therefrom. Each of the second pair of strips has a hook-and-loop type fastening element disposed on an outermost end thereof. Another cloth strip 216 is provided between the strips 214 for holding the strips 214 in place. A series of zipper teeth 213 are provided on one side of the quilt sheet 21 adapted to be,zipped together with the teeth 111 of the inner cover sheet 11. A hook-and-loop type fastening element 212 is disposed on the same side of quilt sheet 21 and adjacent to the top edge of the quilt 21. Hook-and-loop type fastening element 212 is provided for coupling with the hook-and-loop type fastening element 112 disposed on the top portion of the inner cover sheet 11.

Figure 2B:
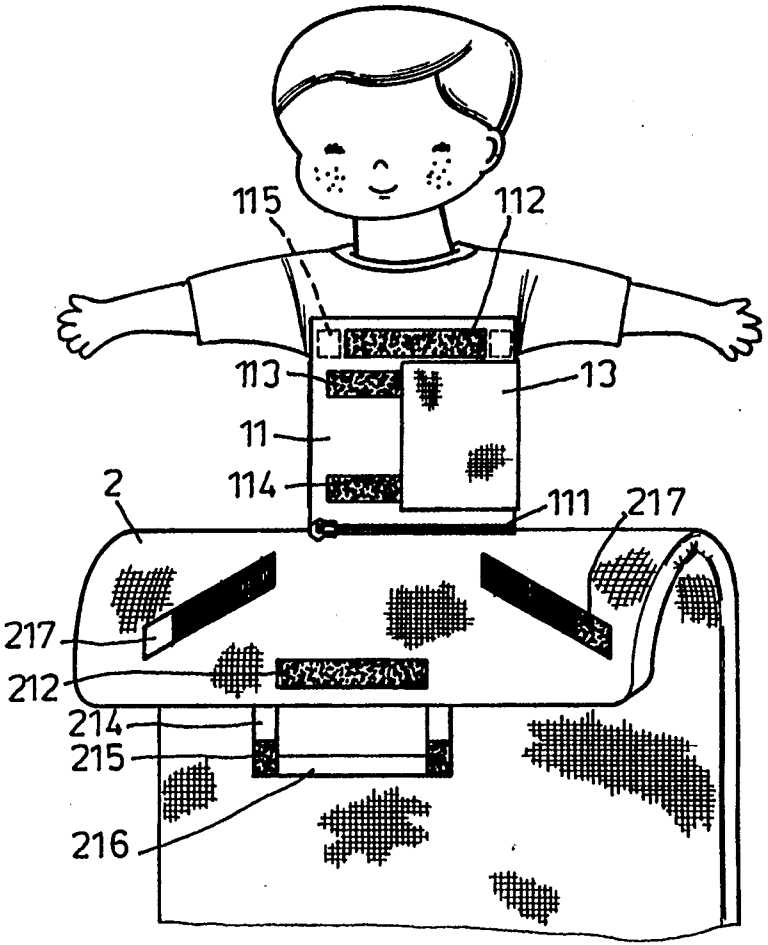
FIG. 2B is a further top view of the wrapping sheet of FIG. 1 showing the wrapping sheet being wrapped around the body of a child.
Figure 2A:
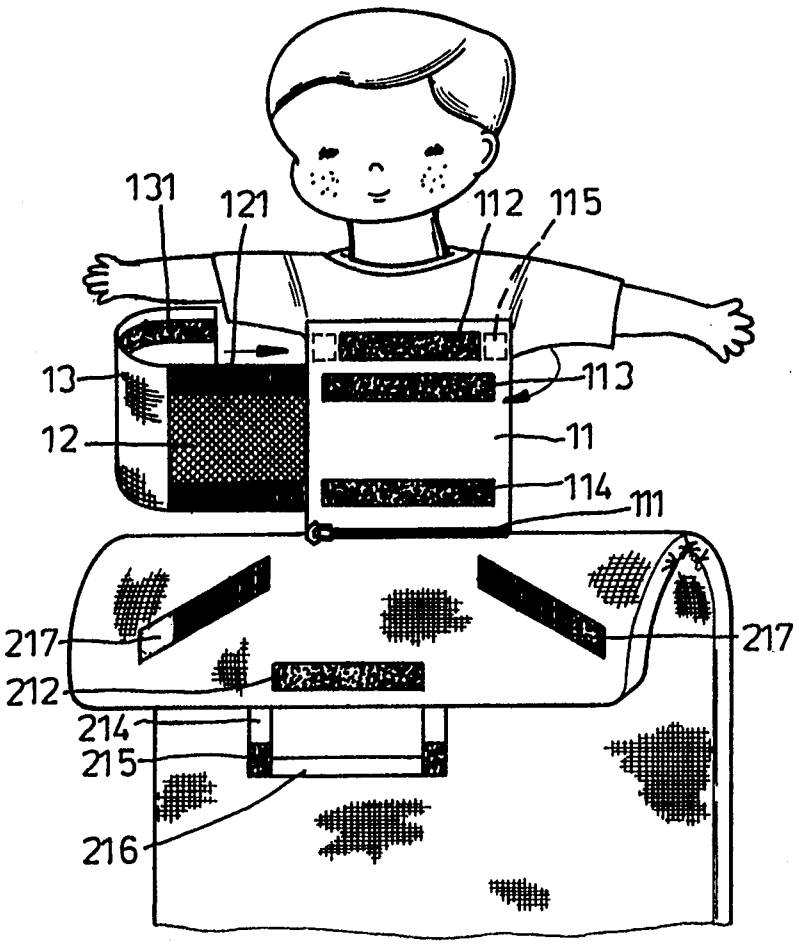
FIG. 2A is a top view of the wrapping sheet of FIG. 1 is a spread out manner.
Figure 3B:
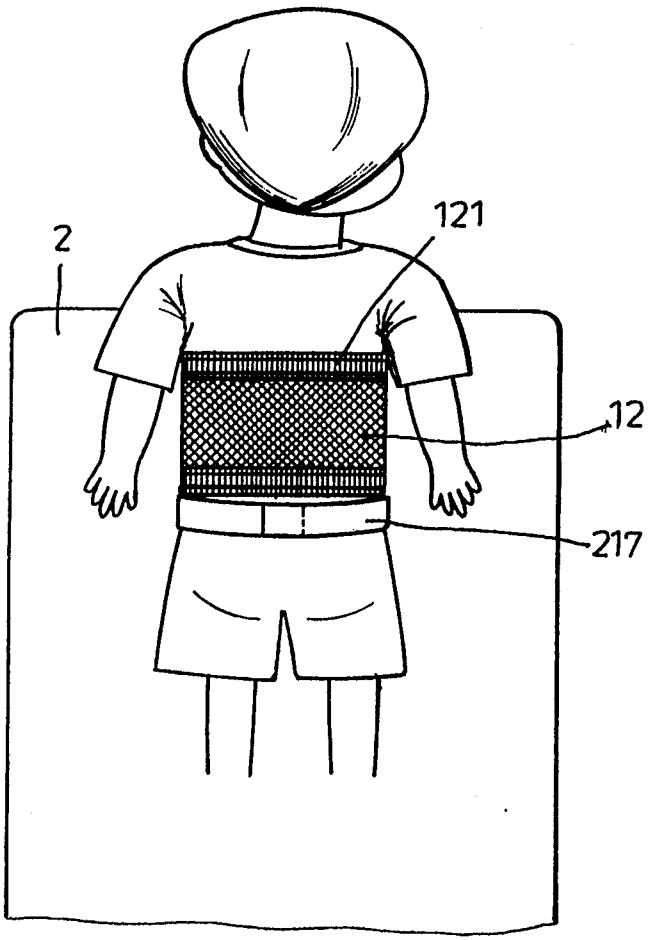
FIG. 3B is a rear view of FIG. 3A.
Figure 3A:
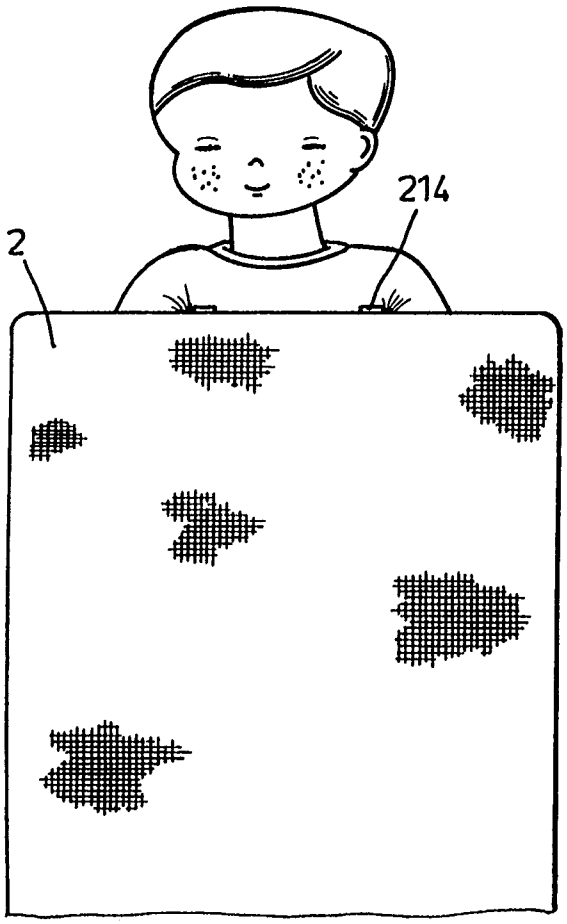
FIG. 3A is another top view of the quilt of FIG. 1 showing the quilt being sealed to the child's body.

In operation, the inner cover sheet 11 of the wrapping sheet 1 is placed on top of the chest of a child, as shown in FIG. 2A. The screen 12 and the outer cover sheet 13 are folded over the back of the child, wrapped around the child, and secured thereto. The outer cover sheet 13 is secured to the inner cover sheet 11 by means of the hook-and-loop type fastening strips 131 and 132, which engage the respective fastening strips 113 and 114, as shown in FIG. 2B. Next, the two sets of teeth 111 and 213 are zipped together. The top of the quilt 2 is then folded toward the wrapping sheet 1 with the fastening element 212 providing a coupling with the fastening strip 112, the second pair of cloth strips wound around the chest and fastened together by hook-and-loop fasteners 217, at the back of the child. The cloth strips 214 are disposed in-between the chest of the child and the inner cover sheet 1. The fastening elements 215 are attached to the respective fastening elements 115. Thus, the quilt is firmly covered on the child's body, as shown in FIGS. 3A, 3B.

The screen 12, which is positioned at the back of the child, allows air to flow therethrough for avoiding sweating and thereby preventing a rash from developing on the child's body, which might otherwise develop.

I claim:

1. A fastener for preventing quilts from being kicked off, comprising:

a wrapping sheet having an inner cover sheet, a screen having one end connected to one end of said inner cover sheet and the other end connected to one end of an outer cover sheet, said inner cover sheet having at least three hook-and-loop type fastener strips secured on one side of said inner cover sheet with a first of said three fastener strips being disposed at a top portion, a second of said three fastener strips being disposed at a bottom portion and a third of said three fastener strips being disposed at a middle portion thereof, a fourth and a fifth hook-and-loop type fastener are respectively disposed on an opposing side of said inner cover sheet adjacent respective top corners thereof, said inner cover sheet having a series of zipper teeth secured to the bottom edge thereof, said screen having a pair of elastic bands respectively disposed on the top and bottom portions thereof, said outer cover sheet having a height dimension less than a height dimension of said inner cover sheet and having at least a sixth and seventh hook-and-loop type fastener strip respectively disposed at a top and a bottom portion thereof for respective securement with said third and second fastening strips of said inner cover sheet to firmly hold said wrapping sheet on a user's body;

a quilt having a a fluffed cotton portion covered by a quilt sheet, said quilt sheet having at least a pair of first cloth strips extending from top edge thereof, each of said first cloth strips having a respective one of a pair of eighth hook-and-loop fastening elements disposed on a distal end thereof, said quilt sheet having a pair of second cloth strips extending from one side thereof, each of said second cloth strips having a respective one of a pair of ninth hook-and-loop fastening elements disposed on a distal end thereof, said quilt sheet having a series of zipper teeth secured to said side of said quilt sheet for coupling with said zipper teeth of said inner cover sheet.

* * * * *